United States Patent [19]

Schmidt et al.

[11] Patent Number: 4,881,766

[45] Date of Patent: Nov. 21, 1989

[54] LOCK MECHANISM

[75] Inventors: Theodore E. Schmidt, Carlton; Alfred J. Peirish, McMinnville, both of Oreg.

[73] Assignee: Pacific Security Systems of America, Inc., Portland, Oreg.

[21] Appl. No.: 94,710

[22] Filed: Sep. 9, 1987

[51] Int. Cl.[4] ..... E05B 51/02

[52] U.S. Cl. ..... 292/201; 292/223; 70/279

[58] Field of Search ..... 292/201, 169.13, 144, 292/333, 169.17; 70/275, 264, 279, 281, 150, 432; 212/223; 340/542, 644

[56] References Cited

U.S. PATENT DOCUMENTS

| | | | |
|---|---|---|---|
| 971,423 | 9/1910 | Walters | 292/201 |
| 1,038,624 | 12/1912 | Messick | 292/201 |
| 1,417,430 | 5/1922 | Tulloch et al. | 292/201 |
| 1,569,228 | 1/1926 | Hurd . | |
| 2,032,765 | 3/1936 | Rolph . | |
| 2,325,225 | 7/1943 | Burke | 292/201 |
| 2,800,347 | 7/1957 | Wardwell, Jr. . | |
| 3,150,894 | 9/1964 | Sant | 292/201 |
| 3,325,203 | 6/1967 | Moler | 292/201 |
| 3,796,073 | 3/1974 | Guiraud | 70/264 |
| 3,988,859 | 11/1976 | Peterson | 292/201 |
| 3,999,411 | 12/1976 | Kambic . | |
| 4,169,616 | 10/1979 | Peterson | 70/275 |
| 4,180,287 | 12/1979 | Youngblood et al. | 292/144 |
| 4,237,711 | 12/1980 | Kambic | 70/150 |
| 4,262,504 | 4/1981 | Inoue | 292/333 |
| 4,342,209 | 8/1982 | Timms et al. | 292/201 |
| 4,406,487 | 9/1983 | Stendal | 292/201 |
| 4,434,635 | 3/1984 | Borgato | 292/201 |
| 4,509,347 | 4/1985 | Young | 70/279 |
| 4,579,376 | 4/1986 | Charlton | 292/144 |
| 4,593,543 | 7/1986 | Schlage et al. | 70/279 |
| 4,677,834 | 7/1987 | Hicks | 70/279 |
| 4,679,416 | 7/1987 | Kambil | 292/169.17 |
| 4,685,709 | 8/1987 | Kambil | 292/201 |

FOREIGN PATENT DOCUMENTS

| | | | |
|---|---|---|---|
| 394445 | 1/1909 | France | 292/201 |
| 2431590 | 3/1980 | France | 292/333 |

*Primary Examiner*—Gary L. Smith
*Assistant Examiner*—Eric K. Nicholson
*Attorney, Agent, or Firm*—Kolisch, Hartwell & Dickinson

[57] ABSTRACT

A lock including a housing having an actuator slidably mounted within the housing. A latch bolt and a door-position sensor are mounted within the housing, each extensible and retractable relative to the housing. The actuator has an intermediate position where the latch bolt and sensor are free to move into the housing, a deadlocking position with the actuator shifted in one direction from this intermediate position where the latch bolt is deadlocked in an extended position with the sensor retracted, and another position which produces retraction of the sensor and latch bolt. A pneumatic device powers movement of the actuator toward its other position and a spring biases the actuator toward its deadlocking position.

8 Claims, 3 Drawing Sheets

LOCK MECHANISM

BACKGROUND AND SUMMARY OF THE INVENTION

This invention relates to a lock or lock mechanism designed for mortise mounting in a door frame, stile, or jamb. The invention more particularly concerns what is referred to herein as a security lock, such as might be used in detention facilities and industrial applications, and includes means for unlocking the lock produced either directly by mechanical action or by remotely controlled means.

The specific and preferred embodiment of the lock herein disclosed is designed for mounting in a narrow-style, jamb or casing structure. The lock includes a mechanical system for deadlocking a latch bolt in the lock in an extended position and with the lock securing a door in a closed position. Unlocking of the lock may be performed mechanically, as with a key actuating a standard mortise key cylinder, and remotely, more specifically by actuating a pneumatically operated device which is operable to produce unlocking of the lock.

So called security locks are known, and exemplary of such are those disclosed in U.S. Pat. Nos. 1,569,228, 2,032,765, 2,800,347, 3,999,411, and 4,237,711. Generally, these prior art devices may be characterized as including a complicated linkage and lever system for producing the unlocking features desired. This has tended to increase the overall size of the mechanism if a rugged, sturdy construction is to be obtained. Most have relied upon an electrically operated solenoid for producing remote unlocking, which is disadvantageous as there is heat build up in a solenoid with the solenoid energized over a long period of time, and solenoids generally are inefficient (without a linkage multiplier) in effecting any long throw, as is desirable in producing multiple locking functions in a lock. Locks which rely on nonmechanical means, such as a fluid or air system for maintaining a deadlocked condition, have the disadvantage in that the deadlocking feature is lost with interruption of the system by which deadlocking is achieved.

A general object of this invention is to provide a lock advantageously employed as a security lock in detention and other facilities, with improved means for either mechanically or remotely effecting unlocking of the lock.

Another object is to provide such a lock mechanism with an improved construction for producing deadlocking of the latch bolt thus preventing the bolt from being retracted using tools or other unauthorized devices.

Another object is to provide a lock mechanism suitable for use in security applications featuring pneumatic means for producing unlocking and, as a corollary, a lock which features a mechanical system for producing deadlocking of the latch bolt without reliance on the pneumatic system.

A preferred and more specific object of the invention is to provide a security lock which includes a pivoted latch bolt movable between locking and unlocking positions, and simplified mechanism including a slidable actuator and a limited number of other parts for shifting the latch bolt to an unlocked state, for producing deadlocking, and other functions.

In a preferred embodiment of the invention, the lock features an elongate, double-section housing portion which encloses operating parts and which mounts a pivoted latch bolt and a door-position sensor, both of which are extensible and retractable relative to the housing. A spring biased, elongate, slidable actuator within the housing is shiftable along its length to produce retraction of the latch bolt and deadlocking of the latch bolt, deadlocking being under the control also of the door-position sensor. The actuator is movable either mechanically, as with a key, or by operation of a pneumatic device, more specifically, an air-operated piston cylinder. With the air-operated piston cylinder removed, as for repair or replacement purposes, mechanical operation of the lock is unimpaired.

These and other objects and advantages are obtained by the invention which is described herein below in conjunction with the accompanying drawings, wherein.

Figure 2:
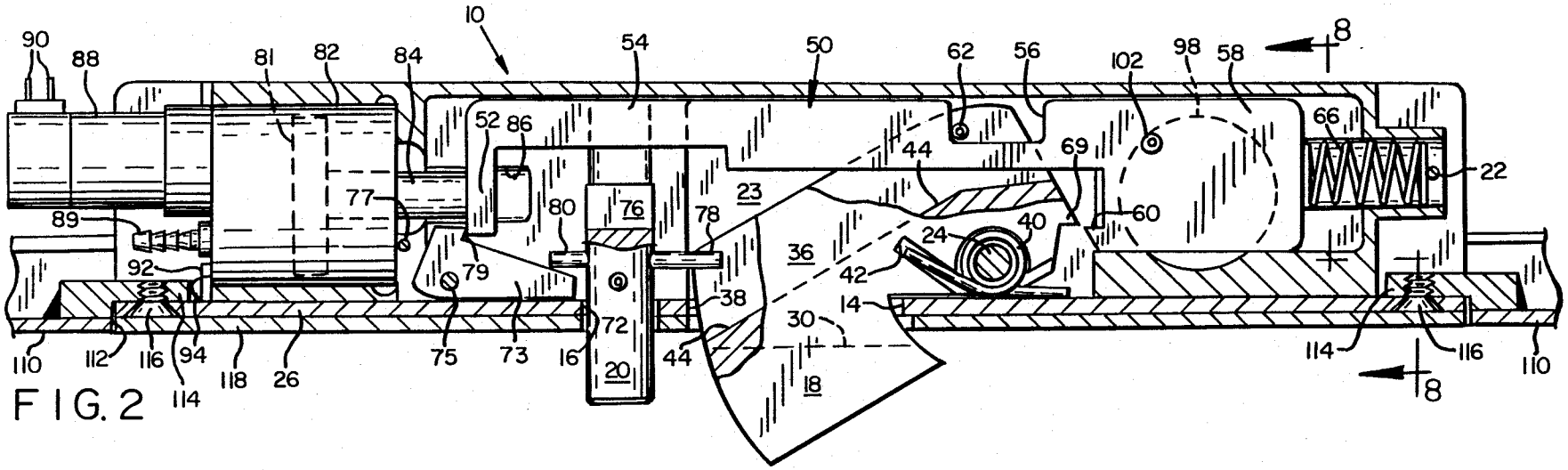
FIG. 2 is an enlarged sectional view of the lock, taken generally along the line 2—2 in FIG. 1 and showing the lock on its side.
Figure 3:
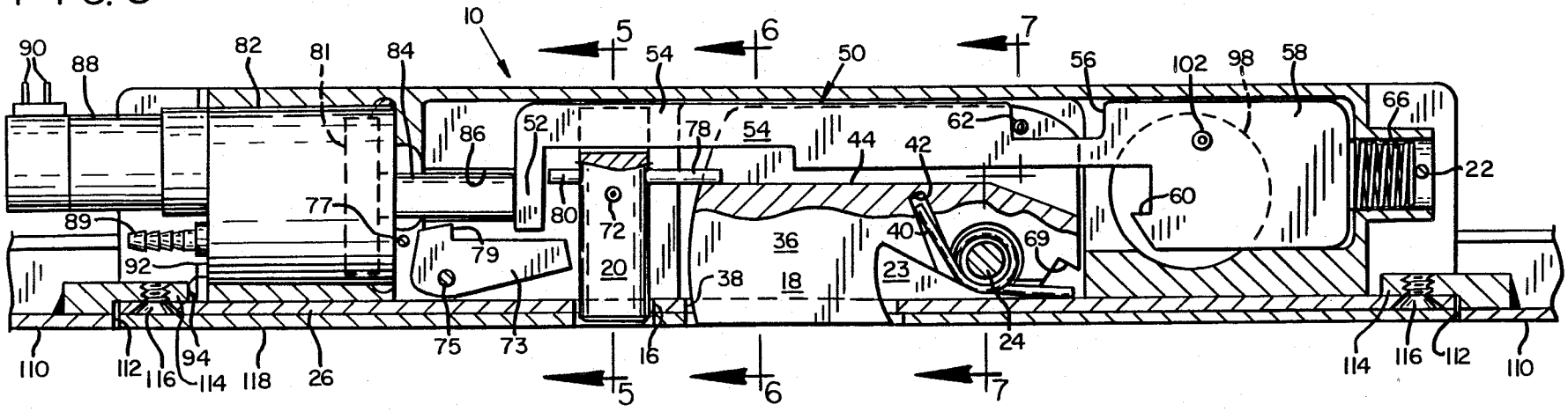
FIGS. 3 and 4 are views similar to FIG. 2, but showing the lock with operating parts in different positions.
Figure 5:
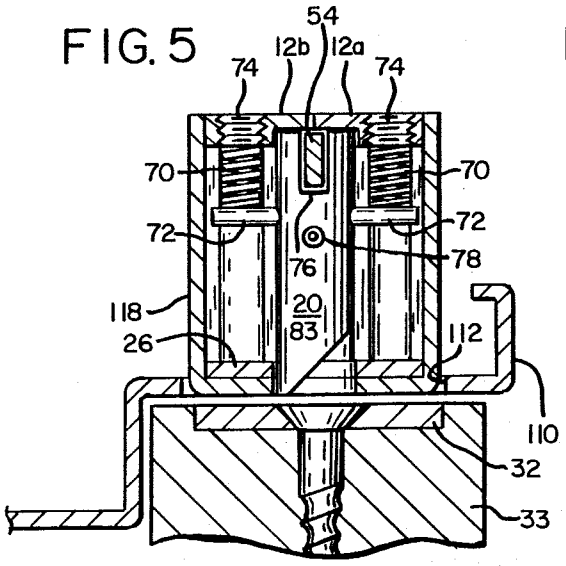
Figure 6:
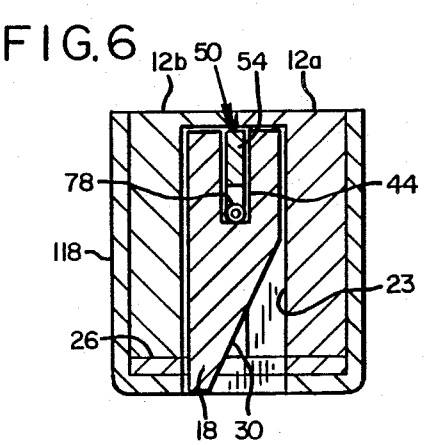
Figure 7:
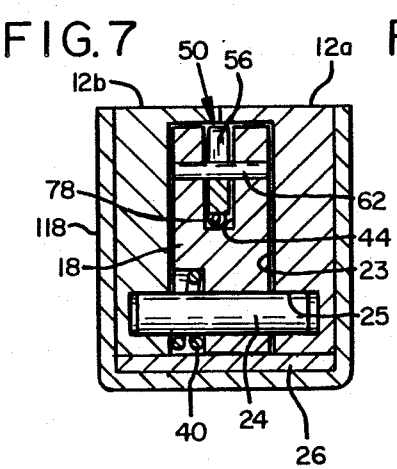
Figure 8:
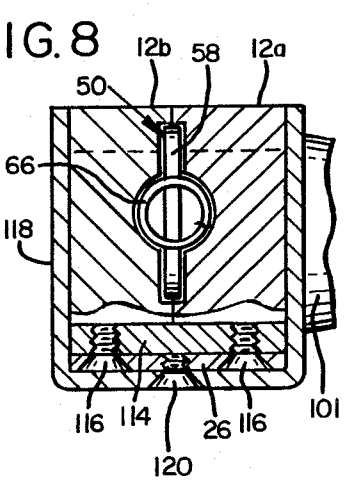

FIGS. 5, 6, and 7 are cross-sectional views, taken along lines 5—5, 6—6, and 7—7, respectively in FIG. 3, and FIG. 8 is a cross-sectional view, taken along the line 8—8 in FIG. 2.

Figure 1:
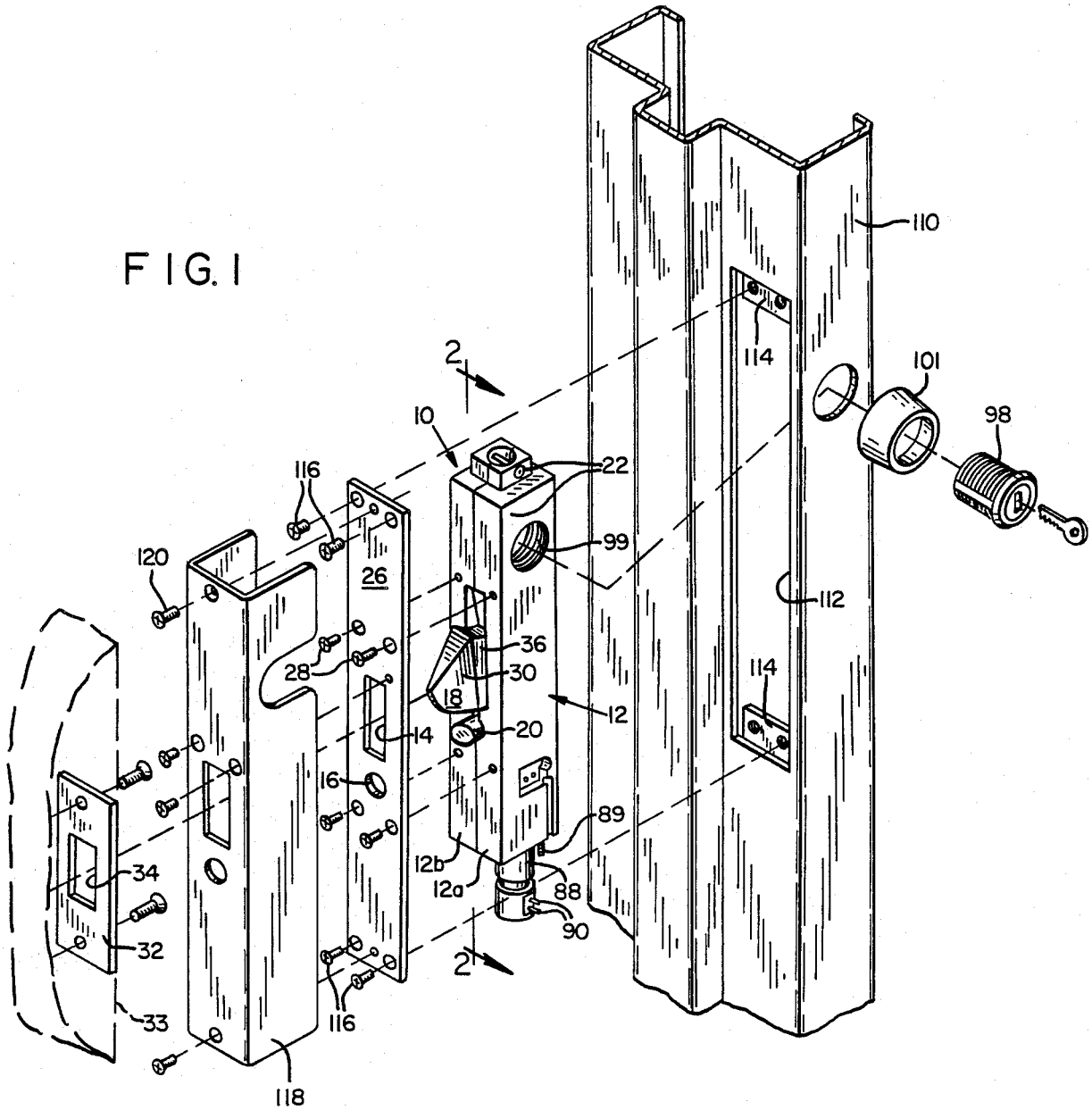
FIG. 1 is an exploded view illustrating the lock and how such might be mounted on a door jamb.

Referring to the drawings, and more particularly to FIG. 1, the lock or lock mechanism in the preferred embodiment illustrated is shown generally at 10. Such includes an elongate, relatively narrow housing body 12. Protruding outwardly to one side of this housing body is a latch bolt 18, and protruding outwardly to one side of the housing body below the latch bolt is a sensor plunger 20, also referred herein to as a door-position sensor.

Figure 4:
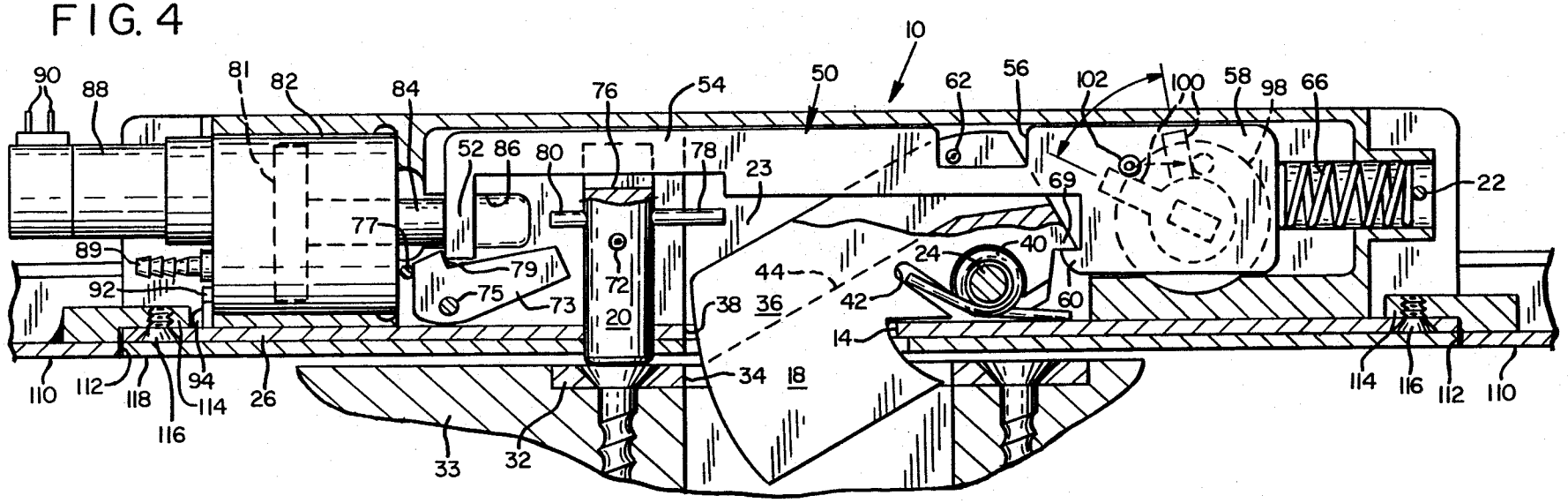

Housing body 12 comprises a pair of elongate housing sections **12*a*, 12*b* which face each other and are secured to one another through suitable fasteners, as exemplified by screws 22. As illustrated in FIGS. 2, 3, and 4, the sides of the housing sections that face each other are suitably recessed whereby mounting chambers are provided within the housing with the sections together for receiving various operating parts of the lock, to be described. The recessing in one housing section is essentially the mirror image of that in the other. This recessing includes recessing defining a chamber 23 receiving latch bolt 18, and wells 25 rotatably journaling the ends of a dowel pin 24** passing through the latch bolt and protruding from opposite sides of the bolt, the dowel pin described constituting pivot means pivotally mounting the latch bolt for pivotal movement between retracted and extended positions.

Referring again to FIG. 1, housing 12 further includes an elongate housing plate 26 extending along a side of the housing suitably secured as by fasteners 28 to the housing sections. Housing plate 26 contains openings 14, 16 through which the latch bolt and sensor plunger extend.

Reverting again to a consideration of the latch bolt and its mounting and referring to FIGS. 1 and 2, the latch bolt has a cam-surfaced end portion 30. With the lock mounted to extend along a door jamb, the usual cooperating strike plate (shown at 32) is mounted on the side of the door 33 being locked by the mechanism. The provision of cam-surfaced end portion enables slam locking, with the latch bolt by reason of the cam surface sliding over the strike plate with closing of the door, thence finally to extend into the bolt well opening 34 in the strike plate.

Inwardly from the cam-surfaced portion, the latch bolt is surfaced by parallel sides, such as side 36, and these snugly slide over and are supported by planar surfaces 38 (see FIG. 2) provided in the housing sections 12*a*, 12*b*. As a consequence, lateral play in the lock bolt is prevented and a rugged, sturdy construction achieved.

The latch bolt is biased outwardly and into a locking position, as shown in FIGS. 2 and 4, by spring 40, having a central portion enveloping dowel pin 24, one end seated within groove 42 in the latch bolt, and its opposite end bearing against the inner surface of housing plate 26 in the assembled lock.

The latch bolt further includes a channel 44 extending the length of the latch bolt along the side thereof opposite cam-surfaced portion 30.

Slidably mounted within and guided for reciprocal movement by internal wall structure of the housing is what is referred to herein as an actuator 50. The actuator includes a leg portion 52, extending out essentially at a right angle from an elongate expanse 54. Expanse 54 is provided with a laterally inwardly recessed notch 56 and terminates in an expanded end 58 remote from leg portion 52. Projecting in an axial direction from end 58 is a deadlocking catch portion 60.

The actuator in the assembled lock has its elongate expanse 54 partially lying in channel 44 of the latch bolt. A pin 62 in the latch bolt spans channel 44 and is received in a lost-motion type of mounting within notch 56.

The actuator is biased in a direction extending from right to left in FIGS. 2, 3, and 4, by a coil spring 66 mounted within a suitable passage extending within the housing. Spring 66 has one end abutting end 58 of the actuator and its other end restrained by a fastener 22.

The latch bolt, in a region approximately opposite deadlocking catch portion 60 of the actuator, is provided with a deadlocking catch portion 69. As will be described, this catch portion cooperates with catch portion 60 to function as a deadlatch means producing a mechanical deadlock of the latch bolt under certain operating conditions of the lock.

Reference earlier has been made to sensor plunger 20. This is reciprocally mounted within a suitable passage formed in the interior of the housing and is biased to protrude outwardly of the housing by coil springs 70 (see FIG. 5) which straddle an end portion of the plunger and have ends abutting pins 72 joined to the plunger. Opposite ends of these springs are confined by fasteners 74 screwed into the housing. The inner end of the plunger is provided with a transversely extending channel 76 which receives expanse 54 of the actuator with the plunger fully retracted within the housing. Also part of the plunger and extending outwardly from opposite sides of the plunger are additional pins 78, 80. Pin 78 protrudes into channel 44 of the latch bolt. The outer end of the plunger is provided with a cam surface 83 (see FIG. 5).

Illustrated at 73 is a deadlatch trigger pivotally mounted within the housing by a pin 75. Pivotal movement in a counter-clockwise direction from the position shown in FIG. 2 is restrained, by reason of a side of the trigger abutting the housing plate. Pivotal movement in the opposite direction is restrained by the trigger striking a pin 77 secured to the housing. The trigger is formed with a shoulder 79 which has leg portion 52 of the actuator extending thereacross. Pin 80 of the plunger, earlier described, lies alongside the trigger.

Shown at 81 is pneumatically operated extensible device, more specifically, an air-operated piston cylinder which includes a cylinder 82 seated within an appropriate cylindrically shaped recess provided within the housing, and an extensible piston rod 84 movable in a passage 86. Device 81 is supplied with air under pressure through a nipple 89. A solenoid operated air valve 88 is opened and closed by actuation of its solenoid to admit or exhaust air from the piston-cylinder device. An electrical control current is supplied the solenoid via conductors 90.

The piston-cylinder device is mounted within the housing and maintained therein through clips such as clip 92 which abut an end of the cylinder in the device and which are fastened to the housing via fasteners 94. With removal of the clips, the piston-cylinder device is readily removed from the housing of the lock, such removal not affecting the mechanical integrity of the mechanical portions of the lock mechanism.

A standard mortise key cylinder (see FIG. 1) is illustrated at 98. Such is mounted in a conventional fashion as by screwing its housing into a threaded bore 99 provided in the housing of the lock. On the inside of the mortise key cylinder with such extending through a spacer 101 is a cam nodule 100 (see FIG. 3) which is rotated through turning of a key inserted into the key cylinder. A pin 102 on the actuator lies adjacent this cam nodule. With key actuated turning of the cam nodule, i.e., mechanical turning of this nodule, pin 102 is engaged to shift the actuator to the right in the drawings.

A mounting for the lock in a door jamb is illustrated by the exploded view set forth in FIG. 1. A door jamb, partially shown at 110, is cut away as shown at 112, and brackets 114 provided on the inside of the door jamb for the mounting of the lock. The housing of the lock is positionable with its housing sections extending into the cut-away portion, and with housing plate 26 having its ends abutting brackets 114. This housing plate may then be fastened in place utilizing fasteners 116. A cover face plate 118 may then be mounted in covering relation over the lock housing with such screwed to the housing plate with fasteners 120.

Describing the operation of the lock, and referring to FIG. 2 which shows the lock with parts positioned as when the door controlled by the lock is open, the latch bolt occupies an extended position where its cam-surfaced end portion protrudes from the housing, urged to this position by coil spring 40. Plunger 20 is in a position protruding from the housing, urged to this position by springs 70. Pin 80 of the plunger, through engagement with the deadlatch trigger, holds the deadlatch trigger positioned as shown with a side thereof flush against the housing plate. The actuator is urged by spring 66 to an intermediate or neutral position wherein its leg portion 52 is against shoulder 79 of the deadlatch trigger and held by the shoulder. With this condition of the parts, the deadlocking catch portions of the actuator and latch bolt are adjacent but out of actual engagement, as shown in the figure.

With slam locking of the door controlled by the lock, the outer end of the latch bolt engages the strike plate of the door with camming of the latch bolt inwardly. Inward movement of the latch bolt is accompanied with retraction of the plunger, with the floor of channel 44 during inward movement of the latch bolt drawing pin 79 and the plunger along with it. Notch 66 permits the latch bolt to swing inwardly with little or no movement imparted to the actuator. With the door closed and the latch bolt moving over the usual bolt well opening 34 in the strike plate, the latch bolt is free to swing outwardly to again assume an extended position, as shown in FIG. 4.

With the door closed, and with the plunger retracted and not free then to extend by reason of continued engagement with the strike plate, its pin 80 has been moved to and remains in the position shown in FIG. 4. This frees the deadlatch trigger, and under the urging of coil spring 66 actuator 50 shifts to the deadlocking position shown in FIG. 4, which is its farthest left position within the housing. Leg portion 52 in the actuator forces the trigger to bear against pin 77. The deadlocking catch portions of the actuator and latch bolt become engaged, thus to lock the latch bolt in its extended position.

To open the lock mechanism, actuator 50 is shifted to the right and past its neutral position to place it in the position shown in FIG. 3. This may be done by pneumatic means, i.e., introducing air to piston cylinder 81 whereby its rod moves outwardly to engage leg portion 52 of the actuator with the actuator then shifting to the right with compression of spring 66. Alternatively, the actuator may be shifted utilizing mechanical means, i.e., the mortise key cylinder earlier described. Regardless of how the actuator-is moved, movement in the actuator results in pin 62 of the latch bolt following the actuator and movement of the latch bolt to a retracted position. Plunger 20 is held retracted. This permits the door controlled by the lock to be opened.

With the door opened, and depressurizing of the piston cylinder or release of the key, as the case may be, the actuator becomes released to move under the urging of spring 66. With such movement, the latch bolt is free to swing outwardly to an extended position. Nothing now restrains the plunger, so the plunger also moves to an extended position with such returning the trigger to the position shown at FIG. 2. The actuator thus returns to its intermediate position illustrated in FIG. 2.

The actuator which controls the operating condition of the lock thus is shiftable to produce unlocking either pneumatically (which may be under remote control) or mechanically, as by using the mortise key cylinder. If desired, an electric switch may be incorporated within the lock to be actuated with reverse turning of a key in the mortise key cylinder, whereby cam nodule 100 rotates in the opposite direction from that earlier described. With this switch electrically connected to the solenoid of the piston-cylinder device, unlocking is achievable at the site of the lock but under the operation of the air-operated piston cylinder.

Earlier it has been described that the piston cylinder is readily removed by loosening clips 92. With removal, the lock may still be utilized in the locking and unlocking of a door. Deadlocking still results with the door closed. Unlocking of the door is performable utilizing the mortise key cylinder.

In the embodiment of the lock described, there are basically only four moving parts, namely, the sensor plunger, the latch bolt, the deadlatch trigger, and the actuator. Lever systems, as are usually found incorporated with solenoid operated locks, may be eliminated. A compact construction is provided permitting mounting of the entire lock within a narrow-style door jamb.

While an embodiment of the invention has been described, it should be obvious that variations and modifications are possible without departing from the invention.

It is claimed and desired to be secured by Letters Patent:

1. A pneumatically operated lock comprising:

a housing, a latch bolt including a cam-surfaced end portion, the latch bolt being movably mounted within the housing and shiftable between an extended position where the end portion protrudes from the housing and a retracted position where the end portion is retracted within the housing, biasing means urging the bolt to its extended position, a sliding actuator movably mounted within the housing for sliding linear movement, means operatively connecting the actuator and latch bolt whereby on movement of the actuator in one direction to one position the latch bolt is shifted to a retracted position, means operatively interposed between the actuator and latch bolt whereby on movement of the actuator in the opposite direction to another position a mechanical deadlock is produced deadlocking the latch bolt in an extended position, said actuator having an intermediate position between said one end and said other positions where the bolt is free to move between extended and retracted positions and urged to its extended position by said biasing means, and a pneumatically operated extensible device for producing movement of the actuator.

2. The lock of claim 1, which further includes a door-position sensor mounted within the housing shiftable between extended and contracted positions relative to the housing, and means interposed between the sensor and the actuator defining said intermediate position of the actuator between its said one and said other positions where the latch bolt is free to move between extended and retracted positions.

3. The lock of claim 2, wherein said pneumatically operated extensible device on extension produces movement of the actuator to its said one position and which further includes biasing means urging said actuator in the opposite direction and to its said other position, and wherein said means interposed between the sensor and actuator comprises a pivotably mounted trigger element shifted to a position defining said intermediate position with the sensor extended.

4. A lock mechanism comprising:

elongate housing having internal walls defining an elongate chamber extending therewithin and an opening in a side of the housing extending from the chamber to the outside of the housing, a latch bolt and means pivotally mounting the latch bolt within the housing, said latch bolt having a cam-surfaced end portion and on pivotal movement moving between an extended position where the end portion is extended from the housing through said opening and a retracted position where the end portion is retracted within the housing, biasing means urging the latch bolt to its said extended position, a sliding actuator mounted within said chamber for sliding linear movement in a slide path therealong, said actuator having one position where the latch bolt is deadlocked in an extended position, another position spaced in the slide path of the actuator from said one position where the deadlock is disengaged and the latch bolt is free to move between its extended and its retracted position and is urged by the biasing means to its extended position, and a third position spaced in said slide path from said one position where the latch bolt is retracted, said another position being located in said slide path intermediate said one and said third position, and power-operated means actuatable to shift the actuator between its various positions.

5. The lock mechanism of claim 4, wherein the housing has another opening in the side thereof, and which further includes a door-position sensor mounted within the housing for movement through said other opening between extended and retracted positions relative to the housing, and means operated by the door-position sensor establishing said other position of the actuator with the sensor in its extended position and said one position of the actuator with the sensor in its retracted position.

6. The lock mechanism of claim 5, wherein said power-operated means comprises a pneumatically operated extensible device mounted within said housing and operable on extension to shift said actuator in its said slide path towards its third position, and which further comprises biasing means mounted within said housing biasing said actuator towards its said one position.

7. The lock of claim 6, wherein said door-position sensor includes means engageable with said latch bolt whereby the sensor is moved to a retracted position with movement of said latch bolt to a retracted position, and wherein said means operated by the sensor comprises a pivoted trigger defining said one position with the sensor retracted.

8. A lock comprising:

a housing, a latch bolt including a cam-surfaced end portion and the latch bolt being movably mounted within the housing for movement between an extended position where the end portion protrudes from the housing and a retracted position where the end portion is retracted within the housing, a sensor plunger movably mounted within the housing for movement between an extended position extended from the housing and a retracted position retracted within the housing, a sliding actuator mounted within the housing for guided guided movement between a deadlocking position and a lock release position, means for deadlocking the latch bolt in an extended position with the actuator in its deadlocking position and with the plunger retracted, means for holding the plunger and latch bolt in their retracted positions with the actuator in its release position, spring-biasing means urging said actuator towards its deadlocking position, mechanically operated means for shifting said actuator against said biasing means into its release position, and a pneumatically operated device detachably mounted on the housing actuatable to shift said actuator to its release position independently of said mechanically operated means, said device being removable from the housing without disturbing the mounting of the actuator and without disturbing said mechanically operated means.

* * * * *